US007556107B2

(12) United States Patent
Weixler

(10) Patent No.: US 7,556,107 B2
(45) Date of Patent: Jul. 7, 2009

(54) CONSTRUCTION MACHINE FOR FOUNDATION CONSTRUCTION

(75) Inventor: Leonhard Weixler, Thierhaupten (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 261 days.

(21) Appl. No.: 11/581,069

(22) Filed: Oct. 16, 2006

(65) Prior Publication Data

US 2007/0102193 A1 May 10, 2007

(30) Foreign Application Priority Data

Oct. 14, 2005 (EP) ..... 05022456

(51) Int. Cl.
*E21B 1/00* (2006.01)

(52) U.S. Cl. ..... 175/135; 175/19; 405/232; 173/184; 173/185

(58) Field of Classification Search ..... 405/232, 405/245, 249; 175/19, 135; 414/23; 173/184, 173/185, 156, 152, 28; 192/3.57
See application file for complete search history.

(56) References Cited

U.S. PATENT DOCUMENTS 3,312,291 A 4/1967 Haug
5,944,452 A * 8/1999 Reinert, Sr. ..... 405/232
2004/0248698 A1* 12/2004 Takagi et al. ..... 477/156

FOREIGN PATENT DOCUMENTS

DE 200 20 031 U1 2/2001
WO 2005/073495 A1 8/2007

* cited by examiner

*Primary Examiner*—David J Bagnell
*Assistant Examiner*—Sean D Andrish
(74) *Attorney, Agent, or Firm*—Jacobson Holman PLLC

(57) ABSTRACT

The invention relates to a construction machine, in particular a drilling and/or pile driving device, for foundation construction comprising a chassis and a leader arranged on the chassis for the longitudinally displaceable guidance of a drive head. Provision is made for the leader to be pivotable on the chassis by means of a pivot drive about a pivot axis that extends at least approximately parallel to the longitudinal axis of the leader. In accordance with the invention at least one locking element is provided which can be displaced between a first position, in which it fixes the leader around the pivot axis in a rotationally fixed manner on the chassis, and a second position, in which the leader is released. In addition, according to the invention a setting device is provided for the remote-controlled displacement of the locking element.

13 Claims, 3 Drawing Sheets

Figure 1:
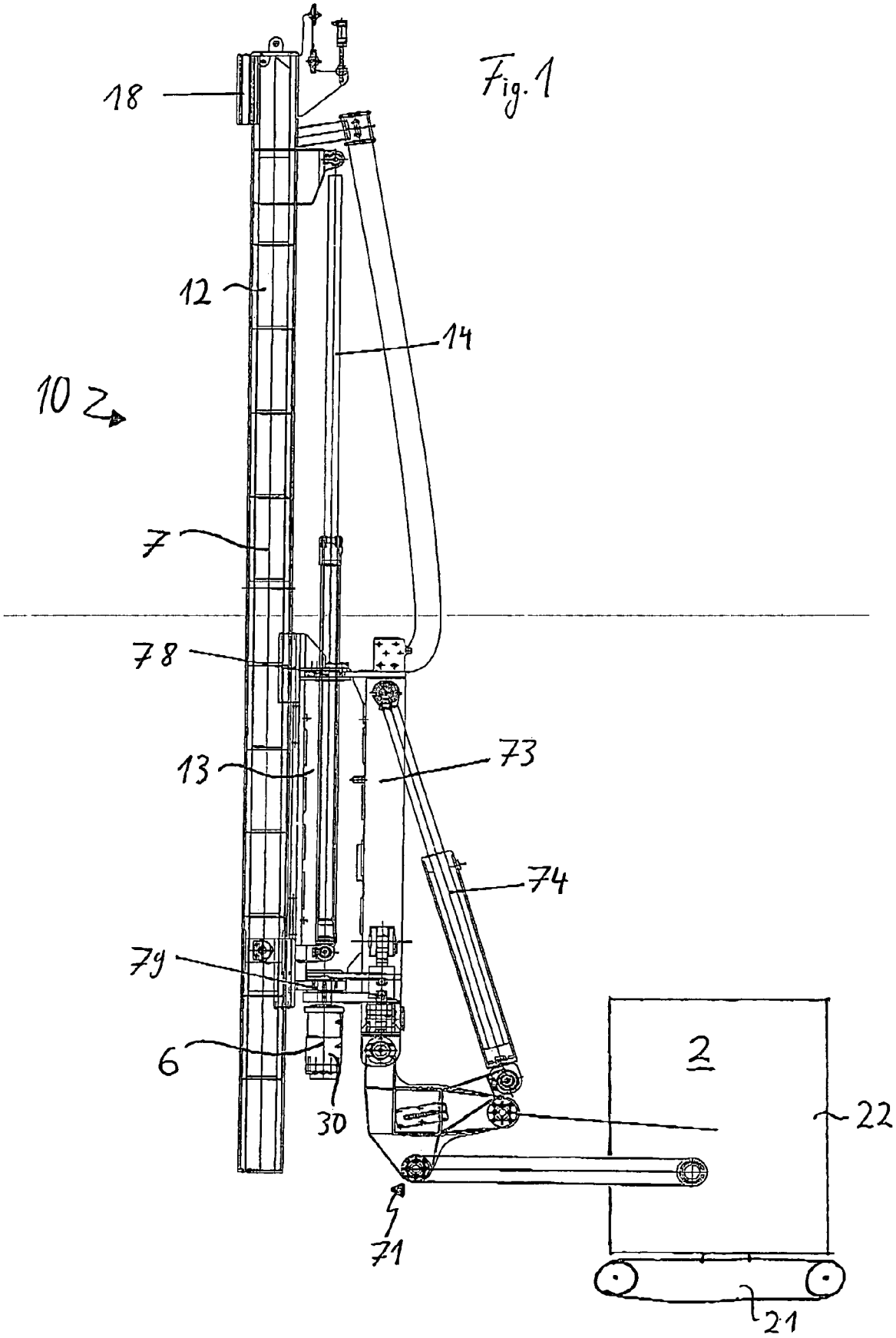

18
12
14
10
7
78
13
73
74
79
6
30
2
22
71
21

CONSTRUCTION MACHINE FOR FOUNDATION CONSTRUCTION

The invention relates to a construction machine for foundation construction according to the preamble of claim 1. A construction machine according to the invention is designed with a chassis, a leader arranged on the chassis for the longitudinally displaceable guidance of a drive head, the leader being pivotably arranged on the chassis about a pivot axis that extends at least approximately parallel to the longitudinal axis of the leader, and a pivot drive for the driven pivoting of the leader about the pivot axis.

Construction machines of such kind are known and can be applied in particular as drilling and/or pile driving devices. In the case of a drilling device the drive head serves to accommodate a drilling tool and can be designed e. g. as a rotary drill head or rotary percussion drill head. Through a displacement of the drive head while the drilling tool is rotating on the leader a borehole is sunk.

In the case of a pile driving device the drive head serves as a supporting element for sheet pile wall elements or foundation elements of a different kind or soil working tools that are pressed into the soil by lowering the drive head longitudinally of the leader. Here the drive head can include a vibrator in particular. Furthermore, a construction machine according to the invention can equally serve as an injection device, in which case an injection tool is attached to the drive head.

To produce tight sheet pile walls it is necessary to precisely arrange the individual sheet pile wall elements directly adjacent to each other. Likewise, when secant boreholes are drilled for example in order to produce retention walls in the soil a precise positioning of the individual boreholes relative to each other is necessary.

A positioning required for this purpose of the drive head with the sheet pile wall element or the soil working tool arranged thereon in the horizontal can be achieved through a displacement of the chassis together with the leader arranged thereon. However, on account of the great amount of mass involved this proceeding is very complicated by comparison. In addition, it is possible to arrange the leader together with the drive head in a pivotable manner on the chassis about a pivot axis extending approximately horizontally, with a pivot drive being provided for the active pivoting of the leader. This additional degree of freedom makes it possible that the element to be introduced into the soil is positioned precisely in the horizontal without having to move the entire chassis.

However, the use of such construction machines with a pivotable leader has shown that in some cases the precision needed for the positioning of the elements to be introduced into the soil leaves a great deal to be desired, especially in the case of changing soil formations and/or when existing foundation elements are cut. In particular, a drifting of the element to be introduced into the soil could be observed during its introduction.

The object of the invention is to further develop a construction machine according to the preamble such that a particularly high precision is guaranteed during the positioning of the drive head and an element arranged thereon that is to be introduced into the soil as early as during the introduction process itself.

In accordance with the invention the object is solved by a construction machine having the features of claim 1. Preferred embodiments are stated in the dependent claims.

A construction machine according to the invention is characterized in that at least one locking element is provided which can be displaceed between a first position, in which it fixes the leader around the pivot axis in a rotationally fixed manner on the chassis, and a second position, in which the leader is released, and in that a setting device is provided for the remote-controlled displacement of the locking element.

A first fundamental idea of the invention can be seen in the fact that on the pivotable support of the leader at least one displaceable locking element is provided that impedes in a first position a relative movement of the leader with respect to the chassis about the pivot axis. In a second position, however, the locking element releases the leader for rotation about the pivot axis on the chassis.

Another fundamental idea of the invention can be seen in the fact that the locking element can be remote-controlled by means of a setting device, more particularly from an operator's cabin located on the chassis.

The locking element according to the invention takes up the torques about the pivot axis that occur during the operation of the construction machine and relieves thereby the pivot drive. More particularly, with the device according to the invention an undesired pivoting of the leader about the pivot axis caused by the operational forces that occur during the soil working can be counteracted effectively. The invention renders it possible that the position of the drive head and the tool arranged thereon is kept extremely precise in the horizontal plane even during drilling operations, which allows for a particularly precise soil working.

In accordance with a preferred embodiment a particularly reliable operation of the construction machine according to the invention is ensured in that the setting device includes at least one hydraulic drive. Alternatively or additionally, for example an electric motor or a different type of drive can be employed for the displacement of the locking element.

The hydraulic drive of the setting device can include an independent hydraulic linear motor, at whose end the locking element is arranged. However, a construction machine of a particularly simple design is achieved according to the invention in that the locking element forms a hydraulic piston of the hydraulic drive. Hence, in this case the locking element is itself part of a hydraulic linear motor and hydraulic fluid is applied directly to the movable locking element for it to be displaced. As a result, the number of movable components is reduced and the reliability of the device according to the invention is increased thereby.

Furthermore, a particularly reliable operation of the construction machine according to the invention can be ensured in that the setting device forms a fixing brake together with the locking element, which can also be referred to as a blocking brake. Such a blocking brake fixes the leader on the chassis when there is no supply of operating means, releasing it only when operating means are being supplied. If use is made of a hydraulic drive the setting device is preferably designed such that the locking element is moved into the first position when a pressure drop occurs at the hydraulic drive. Consequently, such a blocking brake is released hydraulically. Through the use of a blocking brake it is ensured that even during the transport of the construction machine, i.e. when it is out of operation, the leader is connected in a secure and rotationally fixed manner to the chassis.

According to the invention a particularly simple and reliable construction machine can be achieved in that a spring, in particular a cup spring, is provided for returning the locking element into the first position. In this case the fixing force can be applied in a particularly simple manner through spring force. The spring can also be designed as a cup spring assembly in particular.

A construction machine comprising a leader that can be positioned in an especially precise manner can be achieved in that on the locking element at least one friction surface is arranged for the force-locking fixing of the leader on the chassis in the first position of the locking element. In this case the brake can lock in any chosen position of the leader.

For a particularly secure fixing of the leader provision can be made alternatively or additionally for at least one gear element to be arranged on the locking element for the form-locking fixing of the leader on the chassis in the first position of the locking element, The gear element concerned here can be e.g. a tooth or a recess provided for accommodating a tooth.

By preference, the leader includes a shaft formed around the pivot axis, which is surrounded by a sleeve arranged on the chassis. Alternatively or in addition, provision can be made for the chassis to include a shaft formed around the pivot axis which is surrounded by a sleeve arranged on the leader. For best suitability the locking element is designed on the sleeve but in principle it can also be arranged on the shaft. As a result, whilst having a compact construction a secure, rotationally fixed support of the leader is ensured in the first position of the locking element.

A particularly good fixing effect with a simple construction can be provided in that the locking element is designed in a ring-shaped fashion and surrounds the shaft arranged on the leader or the chassis. For displacement of the locking element between the first and the second position it is suitably moved in an approximately parallel manner to the longitudinal axis of the leader, i.e. it is generally moved upwards and downwards in the vertical plane, that is with the leader extending approximately vertically.

An especially good fixing effect results in a most suitable manner from the fact that on the shaft at least one disk element is arranged, against which the locking element can be placed in the first position. To form a multiple-disk brake several disk elements and locking elements can also be provided.

Furthermore, according to a preferred embodiment of the invention a particularly good rotational fixing of the leader is ensured in that on the shaft, in particular on the disk element, two contact faces are provided, wherein in the first position of the locking element a first contact face is in contact with the locking element and a second contact face is in contact with the sleeve. In this case, the leader is fixed on the chassis at two different locations when the locking element is in the first position, A first rotationally fixed connection between leader and chassis exists between the locking element and the shaft on the first contact face. A second rotationally fixed connection exists on the second contact face between shaft and sleeve. To establish a contact at both contact faces provision can be made in particular for the shaft to be displaceable with respect to the sleeve in the direction of the pivot axis during the movement of the locking element into the first position. Advantageously, the disk element has a frustum-like, i.e. cone-shaped peripheral surface, through which a force, especially a normal force, can be applied by means of the locking element in order to fix the leader.

It is particularly suitable for the peripheral surface of the disk element to have a double-cone design, the first contact face being arranged on a first cone-shaped peripheral surface portion and the second contact face being arranged on a second cone-shaped peripheral surface portion that is designed inversely to the first cone-shaped peripheral surface portion. The inverse arrangement is understood in this case in that the two cone-shaped peripheral surface portions taper in opposite directions. By such an arrangement especially large contact faces are made available in compact disk elements, which results in a particularly high retention force.

A particularly reliable and precise pivoting of the leader on the chassis can be achieved in that the pivot drive includes a rotary motor, more particularly a hydraulic rotary motor. In principle, the pivot drive can also include at least one hydraulic linear motor for example.

In accordance with a preferred embodiment a particularly reliable construction machine can be given in that a control is provided which is designed for the automatic displacement of the locking element into the second position during the operation of the pivot drive. To this end provision can be made for instance for the setting device of the locking element to be pressurized to the operating pressure of the hydraulic pivot drive, for which purpose a hydraulic line may be provided that is connected on the one hand to the operating pressure line of the hydraulic rotary motor and on the other hand to the setting device. As a result, the achievement can be made that the locking element is released automatically, in particular hydraulically, when the pivot drive is operated. By the same token, the control can also be designed such that when the pivot drive is at standstill the locking element is displaced automatically into the first position, in which it fixes the leader in a rotationally fixed manner on the chassis.

For best suitability the chassis includes an erectable boom, on which the leader is pivotably supported about the said pivot axis. For the transport of the construction machine such a boom can be displaced from an approximately vertical position into an approximately horizontal position, whereby the leader is tilted down, too. The pivot axis suitably extends externally of the leader, especially between the leader and the boom. For the precise positioning of the leader during soil working operations further pivot drives can be provided in addition to the pivot drive according to the invention in order to displace the leader in particular about approximately horizontally extending axes of rotation. In particular, the leader can be height-adjustable.

Figure 2:
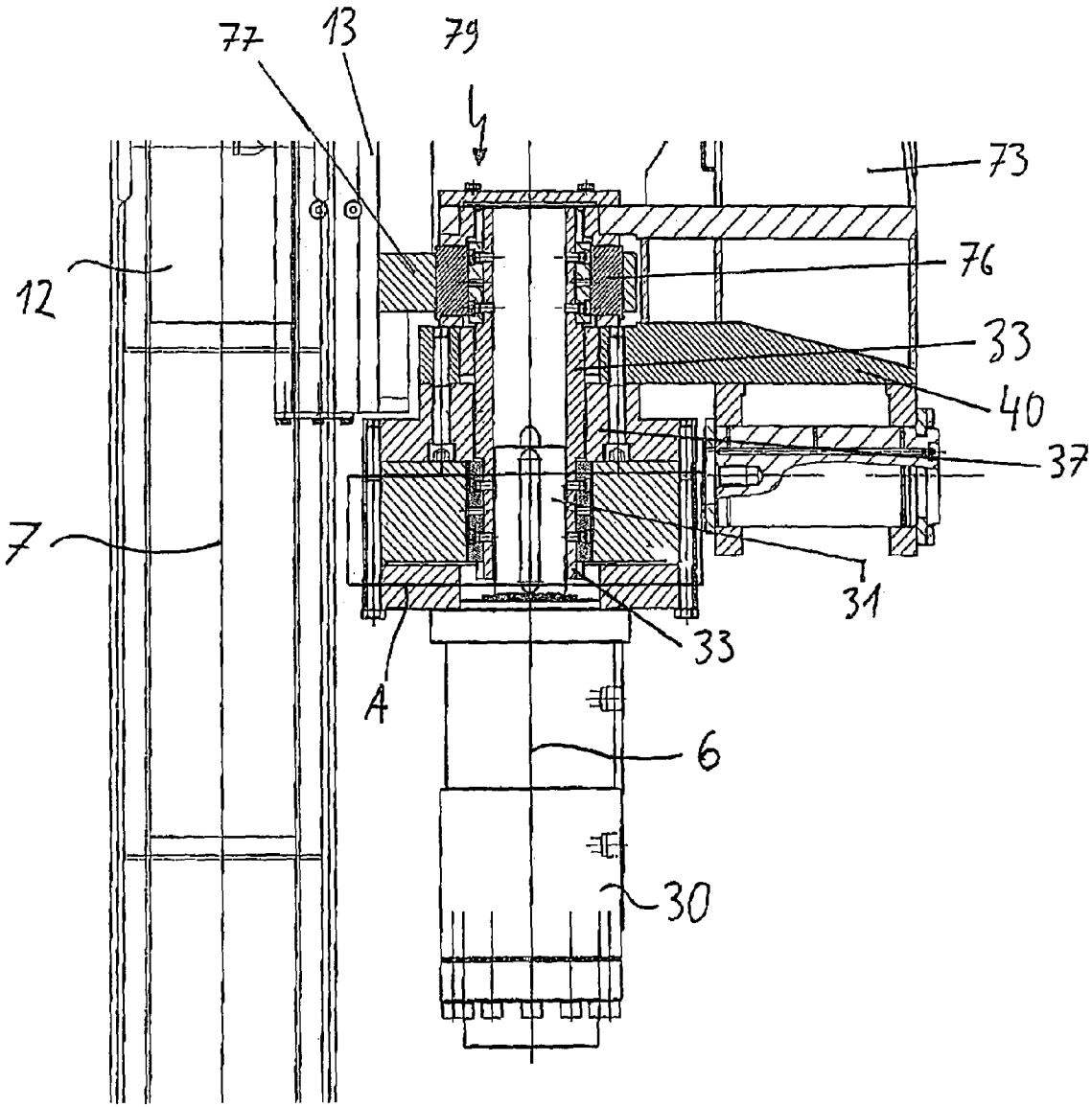
Figure 3:
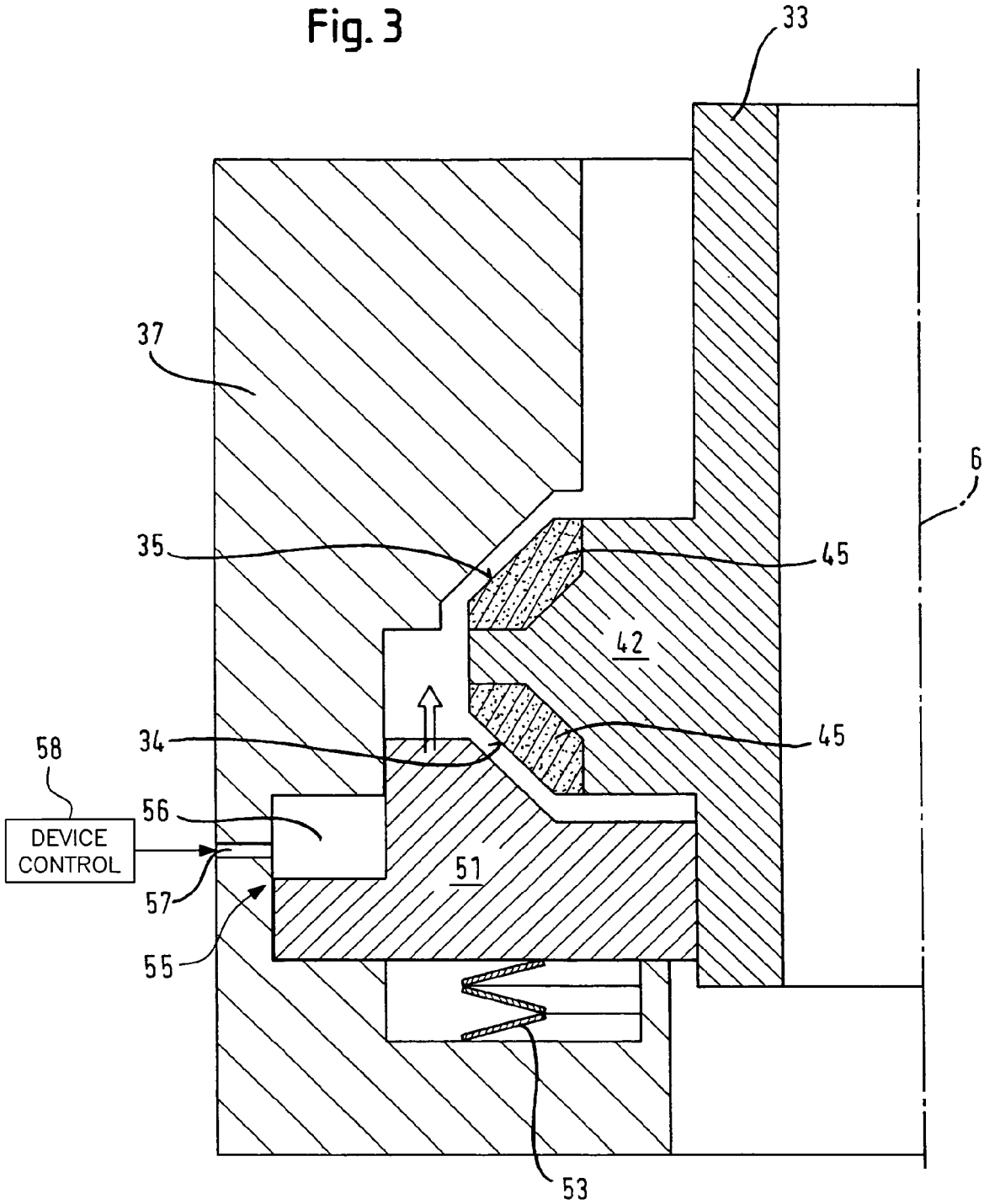

In the following the invention will be described in detail by way of preferred embodiments which are shown schematically in the Figures, wherein:

FIG. 1 shows a lateral view of a construction machine according to the invention;

FIG. 2 shows a partially sectional detail view of the construction machine of FIG. 1 in the portion of the pivot drive, in which the locking element and the disk element are not illustrated for the sake of clarity; and FIG. 3 shows a starkly schematized detail view of the construction machine in portion A of FIG. 2, i.e. in the portion of the locking element, with the said locking element being located in the second position, in which the leader is released.

A construction machine according to the invention which comprises an erectable and pivotable leader is shown in FIG. 1. The construction machine has a leader 10 which is arranged in a pivotable manner on a chassis 2 about a pivot axis 6 extending approximately perpendicularly to the ground surface and parallel to the longitudinal axis 7 of the leader. The chassis 2, depicted here in a roughly schematic manner only, includes a running gear 21 designed as a track-laying gear, on which an upper carriage 22 is arranged in a rotating manner about an approximately vertically extending axis of rotation.

The leader 10 includes a mast element 12 that can be displaced on a guiding slide 13 by means of a hydraulic cylinder 14 for height adjustment. On the mast element 12 a slide 18 is in turn arranged in a longitudinally displaceable manner, which serves as a support of a drive head for a soil working apparatus not depicted here.

The chassis 2 includes a front boom 71, on which an erectable boom 73 is provided in a pivotable manner about an approximately horizontally extending axis. For the transport of the construction machine the erectable boom 73 can be tilted about the approximately horizontally extending axis by means of a hydraulic cylinder 74 from an approximately vertically directed position into an approximately horizontally directed position.

To pivot the leader 10 about the pivot axis 6 it is supported in a rotating manner on its guiding slide 13 on an upper bearing 78 and a lower bearing 79 on the erectable boom 73. The pivot axis 6 extends externally of the mast element 12 between the guiding slide 13 and the erectable boom 73. In the illustrated embodiment the pivot axis 6 coincides with the longitudinal axis of the hydraulic cylinder 14 that is provided for the height adjustment of the mast element 12.

As can be gathered from FIG. 1 and more particularly from FIG. 2, in the portion of the lower bearing 79 a pivot drive 30 designed as a hydraulic rotary motor is provided in order to pivot the leader 10 about the pivot axis 6. For the rotatable support of the leader 10 on the chassis 2 a bearing ring 76 is provided on the lower bearing 79, which is connected through a bridge 77 with the guiding slide 13 of the leader 10. Inside this bearing ring 76 a shaft 33 is arranged symmetrically to the pivot axis 6 that extends from the bearing ring 76 towards the mast base. The shaft 33 is engaged in a rotationally fixed manner by a drive journal 31 of the pivot drive 30. The motor housing of the pivot drive 30 is arranged for its part on a sleeve 37 which surrounds the shaft 33 and is connected through a bridge 40 with the erectable boom 73 of the chassis 2. The bearing ring 76 rests on the sleeve 37.

A detail view of the construction machine according to the invention in portion A of FIG. 2 is shown in a starkly schematized manner in FIG. 3, in which the pivot drive 30 is left out. As can be taken from FIG. 3, inside the sleeve 37 a locking element 51 is provided which can be displaced parallel to the pivot axis 6 and which, for the purpose of fixing the leader 10 on the chassis 2 in a rotationally fixed manner or respectively for fixing the shaft 33 arranged on the leader 10 in a rotationally fixed manner on the sleeve 37 arranged on the chassis 2, can be moved from a second position depicted in the Figure, in which the leader 10 is released, into the direction of the arrow upwards into a first position.

FIG. 3 shows the locking element 51 in the second position in which the leader 10 is released. In this position the locking element 51 is remotely-controlled displaced by a setting device 55 jointly towards the mast base into a stop with the sleeve 37. Between the locking element 51 that surrounds the shaft 33 in a ring-shaped manner and the sleeve 37 that surrounds the locking element 51 a ring-shaped piston space 56 is formed above the locking element 51 for displacement into the second position, which can be acted upon by a pressure fluid via a hydraulic line 57 formed in the sleeve 37. Here the locking element 51 forms a hydraulic piston of the setting device. A control 58 is provided which is designed for the automatic displacement of the locking element into the second position during operation of the pivot drive.

To return the locking element 51 from the lower, second position, in which the leader 10 is released, into the first position, in which the leader 10 is fixed, a spring 53, shown as a compression spring and preferably designed as a cup spring, is provided below the locking element 51, between the said locking element 51 and the sleeve 37. When a decrease of hydraulic pressure occurs in the piston space 56 the spring 53 moves the locking element 51 upwards so that it comes to rest on the shaft 33 and thereby blocks a relative movement of the shaft 33 with respect to the locking element 51. In order to also ensure that a relative movement between the shaft 33 and the sleeve 37 is blocked the locking element 51 is arranged in particular in a form-locking and rotationally fixed manner in the sleeve 37.

In the portion of the locking element 51 the shaft 33 includes a disk element 42, on which the external circumference of the shaft 33 is enlarged. On the peripheral surface of the disk element 42 a frustum-like first contact face 34 is provided, against which the locking element 51 comes to rest in its first position with a surface portion that is equally shaped in a frustum-like manner. The first contact face 34 tapers towards the mast base.

In addition, on the peripheral surface of the disk element 42 a second frustum-like contact face 35 is provided that tapers towards the mast top. This second contact face 35 is provided so as to rest on a corresponding contact face of the sleeve 37 in the first position of the locking element 51. In the second position illustrated in FIG. 3 the second contact face 35 is in turn spaced from the sleeve 37. In order to enable the shaft 33 to come to rest with its second contact face 35 against the sleeve 37 in the first position, the sleeve 37 and the shaft 33 are movably arranged relative to each other in the direction of the pivot axis 6.

If the pressure decreases in the piston space 56 in the second position of the locking element 51 depicted in FIG. 3, the latter is pressed by means of the spring 53 at the first, lower contact face 34 against the disk element 42. As a result, the locking element 51 takes the disk element 42 and the shaft 33 upwards relative to the sleeve 37, whereby the disk element is also pressed against the sleeve 37 at the second, upper contact face 35. Hence, at both contact faces 34, 35 a friction contact between sleeve 37 and shaft 33 is brought about that locks the leader 10 on the chassis 2. To improve the frictional connection between shaft 33 and sleeve 37 friction linings 45 are provided on the contact faces 34, 35 of the disk element 42. Provision can also be made for appropriate friction linings to be located on the corresponding surfaces of the sleeve 37 and the locking element 51.

To allow for a relative movement between sleeve 37 and shaft 33 and to ensure at the same time a secure support of the leader on the lower bearing 79, the sleeve 37 can include several sleeve elements in particular, not all of which are movable relative to the shaft 33.

The invention claimed is:

1. A construction machine for drilling and/or pile driving and foundation construction, the construction machine comprising:

a chassis, a drive head, a leader arranged on the chassis for the longitudinally displaceable guidance of the drive head, the leader being pivotally arranged on the chassis about a pivot axis that extends approximately parallel to a longitudinal axis of the leader, a pivot drive for pivoting the leader about the pivot axis, at least one locking element displaceable between a first position, in which it fixes the leader on the chassis in a rotationally fixed manner about the pivot axis, and a second position, in which the leader is released, and a setting device for remote-controlled displacement of the at least one locking element a shaft included on one of the leader and the chassis, the shaft being formed around the pivot axis, a sleeve surrounding the shaft and arranged on the other of the chassis and the leader, and a locking element formed on the sleeve, the locking element being designed in a ring-shaped manner and surrounding the shaft arranged on the one of the leader and the chassis.

2. The construction machine according to claim 1, wherein the setting device includes at least one hydraulic drive having a hydraulic piston formed by the at least one locking element.

3. The construction machine according to claim 2, wherein the at least one locking element is moved into the first position when a pressure drop occurs at the at least one hydraulic drive.

4. The construction machine according to claim 1, further comprising a spring for returning the at least one locking element into the first position.

5. The construction machine according to claim 1, wherein on the locking element at least one friction surface is arranged for the force-locking fixing of the leader on the chassis in the first position of the at least one locking element.

6. The construction machine according to claim 1, further comprising at least one disk element arranged on the shaft, the at least one locking element being in the first position against the at least one disk element.

7. The construction machine according to claim 1, further comprising, the disk element, first and second contact faces, wherein in the first position of the at least one locking element, the first contact face is in contact with the at least one locking element and the second contact face is in contact with the sleeve.

8. The construction machine according to claim 7, wherein the disk element comprises first and second cone-shaped peripheral surface portions, with the first contact face being arranged on the first cone-shaped peripheral surface portion and the second contact face being arranged on the second cone-shaped peripheral surface portion that is formed inversely to the first cone-shaped peripheral surface portion.

9. The construction machine according to claim 1, wherein the pivot drive includes a rotary motor.

10. The construction machine according to claim 1, further comprising a control for the automatic displacement of the at least one locking element into the second position during the operation of the pivot drive.

11. The construction machine according to claim 4, wherein the spring is a cup spring.

12. The construction machine according to claim 9, wherein the rotary motor is a hydraulic rotary motor.

13. The construction machine according to claim 1, wherein on the at least one locking element at least one gear element is arranged for the form-locking fixing of the leader on the chassis in the first position of the at least one locking element.

* * * * *